US010737139B2

(12) United States Patent
Walker

(10) Patent No.: US 10,737,139 B2
(45) Date of Patent: Aug. 11, 2020

(54) ROTATIONAL AND LINEAR RESISTANCE FORCE EXERCISE APPARATUS

(71) Applicant: Aaron Joseph Walker, Albuquerque, NM (US)

(72) Inventor: Aaron Joseph Walker, Albuquerque, NM (US)

( * ) Notice: Subject to any disclaimer, the term of this patent is extended or adjusted under 35 U.S.C. 154(b) by 0 days.

(21) Appl. No.: 15/674,403

(22) Filed: Aug. 10, 2017

(65) Prior Publication Data

US 2017/0340918 A1 Nov. 30, 2017

Related U.S. Application Data

(62) Division of application No. 14/672,030, filed on Mar. 27, 2015, now abandoned.

(51) Int. Cl.
*A63B 23/12* (2006.01)
*A63B 23/14* (2006.01)
(Continued)

(52) U.S. Cl.
CPC .... *A63B 23/1209* (2013.01); *A63B 21/00069* (2013.01); *A63B 21/0628* (2015.10);
(Continued)

(58) Field of Classification Search
CPC ..... A63B 21/00058; A63B 21/00065; A63B 21/00069; A63B 21/00072; A63B 21/00076; A63B 21/00178; A63B 21/00181; A63B 21/00185; A63B 21/00192; A63B 21/002; A63B 21/0023; A63B 21/005; A63B 21/0051; A63B 21/0052; A63B 21/0056; A63B 21/008; A63B 21/0083; A63B 21/0085; A63B 21/0087; A63B 21/012; A63B 21/0125; A63B 21/015; A63B 21/018; A63B 21/02; A63B 21/021; A63B 21/022; A63B 21/023; A63B 21/025; A63B 21/04;
(Continued)

(56) References Cited

U.S. PATENT DOCUMENTS 4,296,924 A 10/1981 Anzaldua et al.
4,313,603 A * 2/1982 Simjian ..... A63B 22/14 482/131

(Continued)

FOREIGN PATENT DOCUMENTS

WO 2005016464 A1 2/2005
WO 2007139907 A2 12/2007
WO 2011146541 A2 11/2011

OTHER PUBLICATIONS

"Leeway Standing Tummy Twister Heavy Duty with Handle", https://www.amazon.in/Standing-Twister-Exercise-Machine-Fitness/dp/B071S15BDN, 2010.

*Primary Examiner* — Gary D Urbiel Goldner
(74) *Attorney, Agent, or Firm* — Peacock Law P.C.; Philip D. Askenazy; Isaac Estrada

(57) ABSTRACT

An exercise apparatus with an adjustable rotating element around which a force transferring material wraps either clockwise or counterclockwise to provide bidirectional rotational resistance for exercising. The force transferring material is preferably guided to remain in close proximity to the rotating element while wrapping around the rotating element.

16 Claims, 14 Drawing Sheets

(51) Int. Cl.

| | |
|---|---|
| ***A63B 21/00*** | (2006.01) |
| ***A63B 21/062*** | (2006.01) |
| ***A63B 21/005*** | (2006.01) |
| ***A63B 21/008*** | (2006.01) |
| ***A63B 21/012*** | (2006.01) |
| ***A63B 21/02*** | (2006.01) |
| ***A63B 21/055*** | (2006.01) |
| ***A63B 23/02*** | (2006.01) |
| ***A63B 23/035*** | (2006.01) |
| ***A63B 23/04*** | (2006.01) |
| ***A63B 23/00*** | (2006.01) |

(52) U.S. Cl.

CPC ..... *A63B 21/4033* (2015.10); *A63B 21/4034* (2015.10); *A63B 21/4035* (2015.10); *A63B 21/4047* (2015.10); *A63B 21/4049* (2015.10); *A63B 23/14* (2013.01); *A63B 21/005* (2013.01); *A63B 21/008* (2013.01); *A63B 21/0051* (2013.01); *A63B 21/0085* (2013.01); *A63B 21/00181* (2013.01); *A63B 21/00192* (2013.01); *A63B 21/012* (2013.01); *A63B 21/023* (2013.01); *A63B 21/0552* (2013.01); *A63B 21/155* (2013.01); *A63B 21/156* (2013.01); *A63B 23/0238* (2013.01); *A63B 23/03525* (2013.01); *A63B 23/0405* (2013.01); *A63B 23/0482* (2013.01); *A63B 2023/003* (2013.01); *A63B 2208/0204* (2013.01); *A63B 2208/0233* (2013.01); *A63B 2225/093* (2013.01)

(58) Field of Classification Search

CPC ..... A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/06; A63B 21/0608; A63B 21/0609; A63B 21/0618; A63B 21/062; A63B 21/0622; A63B 21/0624; A63B 21/0626; A63B 21/0628; A63B 21/063; A63B 21/0632; A63B 21/068; A63B 21/08; A63B 21/15; A63B 21/151; A63B 21/152; A63B 21/153; A63B 21/154; A63B 21/155; A63B 21/156; A63B 21/159; A63B 21/16; A63B 21/22; A63B 21/222; A63B 21/225; A63B 21/227; A63B 21/4011; A63B 21/4013; A63B 21/4015; A63B 21/4027; A63B 21/4029; A63B 21/4031; A63B 21/4033; A63B 21/4039; A63B 21/4041; A63B 21/4045; A63B 21/4047; A63B 21/4049; A63B 22/0046; A63B 22/14; A63B 22/18; A63B 2022/185; A63B 2023/003; A63B 23/02; A63B 23/0205; A63B 23/0211; A63B 23/0216; A63B 23/0222; A63B 23/035; A63B 22/03508; A63B 23/03516; A63B 23/03525; A63B 23/04; A63B 23/0405; A63B 23/0482; A63B 23/0494; A63B 23/08; A63B 23/10; A63B 26/00; A63B 26/003; A63B 2026/006; A63B 2208/0204; A63B 2208/0209; A63B 2225/09; A63B 2225/093

See application file for complete search history.

(56) References Cited

U.S. PATENT DOCUMENTS

| | | | | |
|---|---|---|---|---|
| 4,373,717 | A | 2/1983 | Lambert, Jr. | |
| 4,390,180 | A * | 6/1983 | Simjian | A63B 22/14 482/131 |
| 4,391,441 | A * | 7/1983 | Simjian | A63B 22/14 482/131 |
| 4,478,413 | A | 10/1984 | Siwula | |
| 4,515,363 | A | 5/1985 | Schleffendorf | |
| 4,602,618 | A | 7/1986 | Berze | |
| 4,673,180 | A | 6/1987 | Rice | |
| 4,878,663 | A | 11/1989 | Luquette | |
| 4,893,808 | A | 1/1990 | McIntyre et al. | |
| 4,988,098 | A | 1/1991 | Miller | |
| 5,067,708 | A | 11/1991 | Oschansky et al. | |
| 5,118,098 | A | 6/1992 | Jones | |
| 5,152,733 | A | 10/1992 | Farenholtz et al. | |
| 5,284,464 | A * | 2/1994 | Lee, III | A63B 69/365 482/121 |
| 5,336,138 | A | 8/1994 | Arjawat | |
| 5,344,374 | A | 9/1994 | Telle | |
| 5,399,140 | A * | 3/1995 | Klippel | A63B 22/18 482/123 |
| 5,599,262 | A * | 2/1997 | Shih | A63B 22/14 482/146 |
| 5,709,637 | A | 1/1998 | Gow et al. | |
| 5,718,654 | A | 2/1998 | Kennedy | |
| 5,776,039 | A * | 7/1998 | Perez, Jr. | A63B 21/055 482/121 |
| 5,788,607 | A | 8/1998 | Baker | |
| 5,888,182 | A * | 3/1999 | Shih | A63B 22/14 482/146 |
| 6,106,437 | A | 8/2000 | Brooks | |
| 6,261,212 | B1 | 7/2001 | Vallone et al. | |
| 6,283,899 | B1 | 9/2001 | Charnitski | |
| 6,875,159 | B2 | 4/2005 | Chuang | |
| 7,081,074 | B1 * | 7/2006 | Rubin | A63B 22/14 482/146 |
| 7,137,928 | B1 * | 11/2006 | Chen | A63B 22/0056 482/53 |
| 7,150,682 | B2 * | 12/2006 | Varner | A63B 21/02 473/257 |
| 7,604,576 | B2 | 10/2009 | Drechsler | |
| 7,621,861 | B1 | 11/2009 | Kalember et al. | |
| 7,625,318 | B1 | 12/2009 | Heyn | |
| 7,628,736 | B2 | 12/2009 | Vandyke | |
| 7,909,747 | B1 | 3/2011 | Lacaze | |
| 7,927,262 | B2 | 4/2011 | Clark | |
| 7,951,054 | B2 | 5/2011 | Snow et al. | |
| 3,047,973 | A1 | 11/2011 | Berenshteyn | |
| 8,834,328 | B1 | 9/2014 | Batca | |
| 2002/0151417 | A1 | 10/2002 | List | |
| 2004/0097337 | A1 * | 5/2004 | Chuang | A63B 22/001 482/52 |
| 2005/0043143 | A1 * | 2/2005 | Chuang | A63B 22/14 482/51 |
| 2005/0227827 | A1 | 10/2005 | Liester | |
| 2006/0040799 | A1 | 2/2006 | Pompile | |
| 2006/0252614 | A1 | 11/2006 | Rotondale et al. | |
| 2007/0161472 | A1 | 7/2007 | Drechsler | |
| 2008/0004164 | A1 | 1/2008 | Alsip | |
| 2008/0058182 | A1 | 3/2008 | Pompile | |
| 2008/0176722 | A1 | 7/2008 | Steffee | |
| 2009/0163337 | A1 * | 6/2009 | Petrakov | A61H 1/005 482/147 |
| 2010/0317497 | A1 * | 12/2010 | Nadim | A63B 21/0618 482/142 |
| 2011/0111925 | A1 | 5/2011 | Hobson et al. | |
| 2011/0118096 | A1 * | 5/2011 | Nadim | A63B 21/0618 482/142 |
| 2011/0237407 | A1 * | 9/2011 | Kaleal | A63B 21/025 482/114 |
| 2011/0287914 | A1 | 11/2011 | Morris | |
| 2012/0322624 | A1 * | 12/2012 | Wu | A63B 22/203 482/52 |

(56) References Cited

U.S. PATENT DOCUMENTS

| | | | | |
|---|---|---|---|---|
| 2014/0087923 | A1* | 3/2014 | Warren | A63B 23/0476<br>482/57 |
| 2014/0121063 | A1* | 5/2014 | Wireman | A63B 5/16<br>482/23 |
| 2014/0194260 | A1* | 7/2014 | Campanaro | A63B 21/068<br>482/131 |
| 2014/0336006 | A1* | 11/2014 | Miller | A63B 21/154<br>482/52 |
| 2015/0297932 | A1 | 10/2015 | Wehrell | |
| 2016/0279459 | A1* | 9/2016 | Walker | A63B 21/4047 |
| 2018/0361200 | A1* | 12/2018 | Walker | A63B 21/4047 |

* cited by examiner

ROTATIONAL AND LINEAR RESISTANCE FORCE EXERCISE APPARATUS

CROSS-REFERENCE TO RELATED APPLICATIONS

This application is a divisional application of U.S. patent application Ser. No. 14/672,030, filed Mar. 27, 2015, entitled "Rotational and Linear Resistance Force Exercise Apparatus", the specifications and claims of which are incorporated herein by reference.

BACKGROUND OF THE INVENTION

Field of the Invention (Technical Field)

The present invention relates generally to exercise devices, and more particularly to body exercise equipment that utilizes a resistance force to provide the user with rotational, as well as linear force to exercise.

Description of Related Art

Athletes, as well as physical therapists, have understood the need to strengthen, increase range of motion, and improve proprioception of the various parts of the body. Most commonly, fitness devices provide the user with an opportunity to extend and/or retract their limbs and/or torso, while acting against some kind of resistance force provided by an exercise apparatus. This is referred to as flexion and extension of the muscles. Rotational strengthening of various parts of the body provides a unique method of strengthening the body, as opposed to flexion and extension. Rotational strengthening involves supination, and pronation of the limbs, in whole or in part, as well as left and right rotation of the neck, spine, or both. It is currently difficult to exercise the body in a rotational fashion because current inventions provide the user with an opposing linear force, rather than an opposing rotational force against which to interact their muscles. There are several muscles, and groups of muscles which benefit directly from rotational strengthening. While some currently available devices utilize rotational force for exercising, these systems lack in the ability to select the range of motion, as well as allow the user to attach several different unique attachments. There is a current need for a device which allows the user to gain strength by working against a restrictive force, in a rotational fashion, with multiple parts of their body. Furthermore, exercise equipment users are often limited in area to accommodate exercise equipment, therefore exercise apparatuses should ideally take up a small amount of space while providing many functions.

Embodiments of the present invention preferably allow the user to adjust the range of rotation that an exercise apparatus will encompass relative to the user. This allows users to strengthen their muscles more completely, and increase range of motion. Embodiments of the present invention preferably allow users to adjust the height of an attachment point for various attachments. This allows people of differing heights to utilize the same machine after adjusting it to their height. Embodiments of the present invention allow the user to rotate the attachment point in a plane that is perpendicular to the plane of the force rotation of the attachment point, resulting in a downward, sideward, and upward plane for connecting the various attachments. Embodiments of the present invention allow the users to supinate, pronate, rotate, and/or twist the hand, wrist, forearm, elbow, upper arm, shoulder, neck, spine, lumbar, hip, upper leg, knee, lower leg, ankle, and/or foot, utilizing attachments, or no attachments while working that same motion against resistance force as low as zero pounds of force, in a bidirectional fashion. In addition, embodiments of the present invention provide versatile equipment that uses little space.

BRIEF SUMMARY OF THE INVENTION

Embodiments of the present invention comprise an exercise apparatus comprising an adjustable rotating element around which a force transferring material wraps either clockwise or counterclockwise to provide bidirectional rotational resistance for exercising, and the force transferring material guided to remain in close proximity to the rotating element while wrapping around said rotating element. In one embodiment, the rotating element is a circular wheel. In one embodiment, the circular wheel is capable of accommodating the force transferring material on its periphery, for example in a groove. In one embodiment, the force transferring material is selected from the group consisting of a cable, a belt, a chain, a rope, and a rubber band, preferably guided with pulleys disposed in proximity to the rotating element. In one embodiment, the rotating element adjusts horizontally between 1 and 360 degrees vertically and between approximately 1 foot and approximately 10 feet high. In one embodiment the apparatus comprises interchangeable attachments disposable on the rotating element, such as a head accommodating attachment, a long shoulder handle attachment, a twin free spin plate, etc. In a different embodiment, an attachment for a particular exercise is permanently affixed to the adjustable rotating element.

One embodiment comprises a connectable attachment for a bidirectional rotating resistance exercise apparatus comprising a surface on which a user places the user's hand to strengthen the user's shoulder joint and elbow joint and wrist joint and related muscles in supination, pronation and rotation motions.

One embodiment comprises a connectable attachment for a bidirectional rotating resistance exercise apparatus comprising a surface on which a user places at least one foot of the user to strengthen the user's hip joint, knee joint, ankle joint and spine and related muscles in supination, and pronation, and rotation motions.

One embodiment comprises a connectable attachment for a bidirectional rotating resistance exercise apparatus comprising a knee cradle on which users place one knee to strengthen the user's hip joint and related muscles in supination, pronation, and rotation motions.

One embodiment comprises a connectable attachment for a bidirectional rotating resistance exercise apparatus comprising an over-head adjustable handle which a user can hold to strengthen the user's spine, hip, knee and ankle joints and related muscles in a rotating motion.

Another embodiment comprises a connectable attachment for a bidirectional rotating resistance exercise apparatus comprising an elbow cradle with which a user strengthens the user's shoulder joint and muscles in supination, pronation, and rotation motions.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
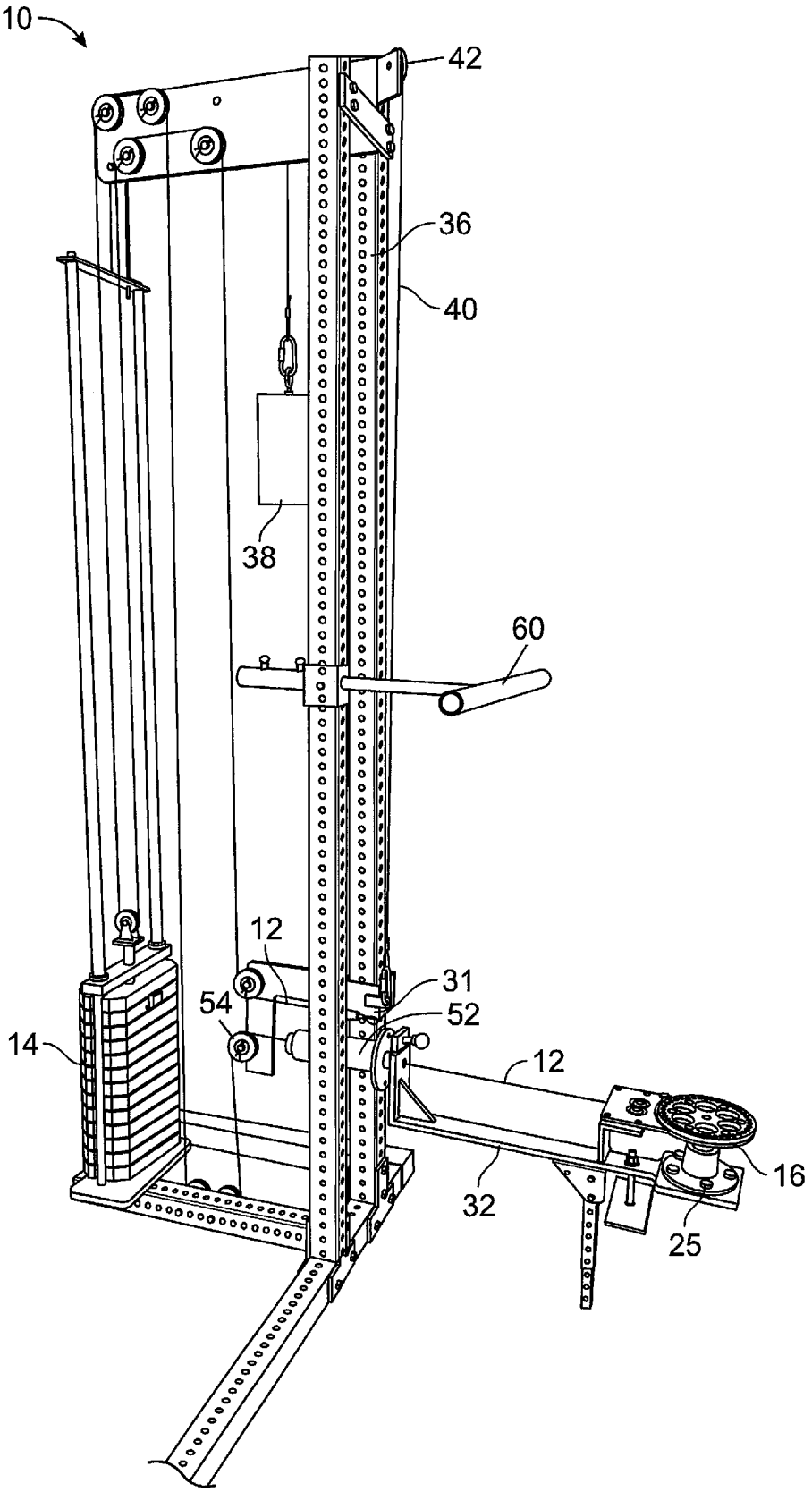
FIG. 1 is a perspective view of an embodiment of the present invention.

In the following detailed description, numerous specific details are set forth in order to provide a thorough understanding of the embodiments of the invention. However, upon studying this application, it will be understood by one of ordinary skill in the art that the embodiments may be practiced without these specific details. For instance, well known operation or techniques may not be shown in detail. Technical and scientific terms used in this description have the same meaning as commonly understood to one of ordinary skill in the art to which this subject matter belongs.

As used throughout this specification and claims the term "rotate" means to turn around a center of rotation in a clockwise, or counterclockwise motion. As used throughout this specification and claims the term "rotating element" means a component to which a force transmitting material is connected to, for example, be wrapped around to provide rotational resistance, and comprises, for example, a circular, elliptical, rectangular, triangular, or the like, shape. As used throughout this specification and claims, the term "force transmitting material" means a component by which force is exerted to provide resistance, including, but not limited to, a cable, rope, chain, belt, rubber band, and the like. Similarly, as used throughout this specification and claims the term "rotational" means to rotate as in, for example, moving in a circular manner, etc. As used throughout this specification and claims, the term "pronation" means to rotate towards the center of the front of the body, while the term "supination" means to rotate away from the center of the front of the body.

Working muscles against resistance in a rotational motion improves the stability of the body part being exercised. The improvements in strength are accompanied by a better understanding of the body, and its range of motion. This new understanding of the body, allows the user of embodiments of the present invention to become more stable and stronger overall. Rehabilitation, injury prevention, and overall strength of certain body parts can be accomplished very quickly when rotational resistance such as the one provided by embodiments of the present invention is utilized as part of an exercise routine.

Generally, rotational motions of the body occur when naturally moving the body while, e.g., walking, running, biking, swimming, throwing, jumping, using tools, and many other motions routinely performed by the body. Strengthening the rotational aspects of the body makes a person's body stronger overall and helps to heal or prevent injuries.

Furthermore, most users of exercise equipment have a limit in the amount of space they can allot to be used by one piece of equipment. A piece of exercise equipment that has multiple functions built into one unit saves real estate space to be used for another purpose.

In one embodiment, a bidirectional force is created by changing the direction of an initially linear force. This is accomplished by changing the linear direction of the original force, for example, a force transferred by a cable, into a force acting upon the tangent of a circumference. When the force acts upon the tangent of the circumference, it gives the user a force to counteract in a rotational fashion. There is no need, in the embodiments of the present invention, for the user to support the perpendicular forces of the exercise motion; the user needs only to rotate around the centerline to counteract the bidirectional opposing force.

In a different embodiment, bidirectional rotational resistances is accomplished through, for example, braking systems, friction, magnetic devices, electric devices, springs, stretching a flexible material, hydraulic devices, pneumatic devices, and the like.

The bidirectional opposing force offered by the various embodiments of the present invention allows the user to exercise clockwise, and counterclockwise movements as needed for the various attachments. The bidirectional feature of the present invention is beneficial to the user due to the fact that the body parts rotate in both directions, and those rotations are made possible through muscles which will benefit from resistance exercise.

Figure 2:
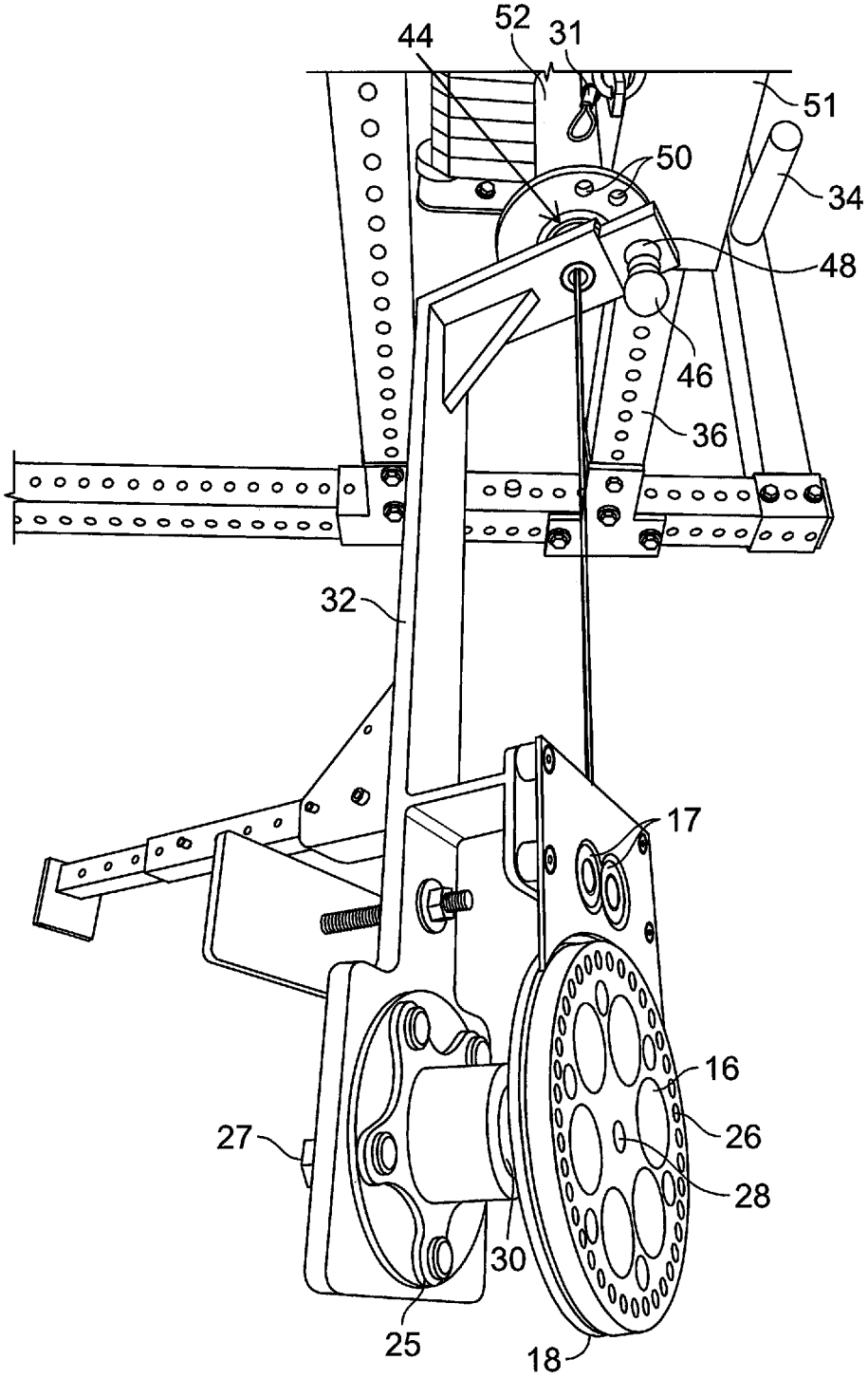
FIG. 2 is a closer view of the adjustable wheel platform arm of the embodiment of FIG. 1.
Figure 3:
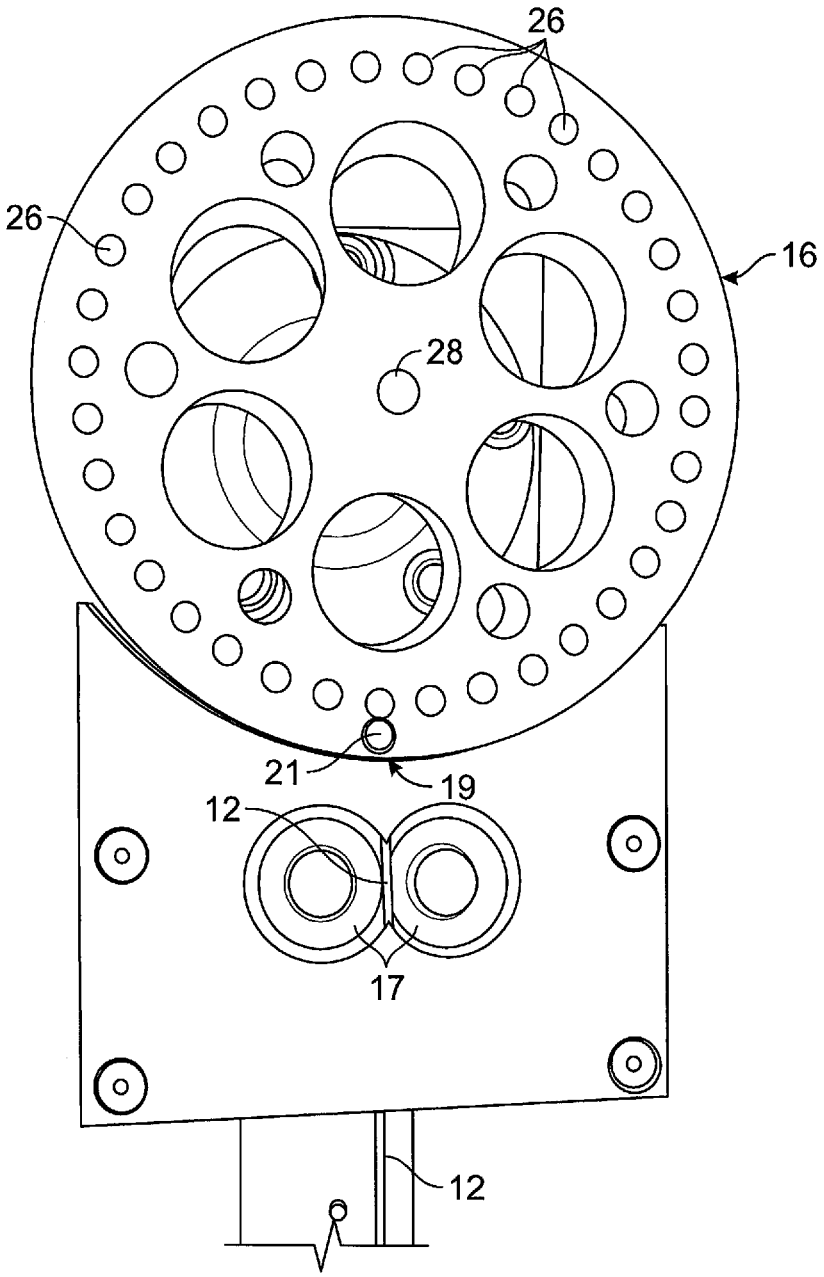
FIG. 3 is a top view of the wheel of the embodiment of FIG. 1.

Referring to FIGS. 1-3, in one embodiment, exercise apparatus 10 comprises original linear force X preferably with a linear direction and preferably being transferred by a force transferring material, such as cable 12. Cable 12 is preferably connected to weights 14 at one end and to wheel 16 at its opposite end. In one embodiment, wheel 16 has a circular shape and comprises groove 18 on its periphery to accommodate cable 12 when turned in either a clockwise or a counterclockwise direction. Optionally, wheel 16 comprises a shape other than circular, for example, elliptical. In one embodiment, a mechanism is provided to guide cable 12 as it wraps around wheel 16, for example, pulleys 17 are preferably disposed on either side of cable 12 relatively near wheel 16 (e.g., most preferably between approximately 0.25 inches and approximately 6 inches), to guide cable 12 into groove 18, thus maximizing transition of force from cable 12 to wheel 16. Preferably, wheel 16 is mounted onto moving axle 20 preferably comprising, for example, bearings (not shown). Preferably wheel 16 is connected to axle 20, e.g., welded, bolted, etc. In one embodiment, axle 20 inserts into hub 25, and nut 27 is then placed on an end opposite to the end where wheel 16 is disposed. Preferably cable 12 is attached to wheel 16 by placing cable ball 21 into cable receiver 19. Bi-directional motions which act upon cable 12 in a motion, which lifts weights 14, are commenced by the user spinning wheel 16, alone, or optionally with an attachment.

In one embodiment, attachments for various exercises are preferably secured onto wheel 16 through, for example, one or more easy insertion/release pins, which optionally pass through center perforation 28, on wheel 16, and/or optionally pass through off center perforations 26. The face of wheel 16 is preferably a substantially flat plane surface of wheel 16, through which easy insertion/release pins pass in a perpendicular plane of motion. Quick release of the attachments allows the user to quickly change the optional attachments if so desired, thus saving time.

In one embodiment, a free end of the force transferring material is made available to the user, with for example, cable attachment 31, in order to provide an attachment point for several different pre-existing attachments. This provides an optional value added feature. This attachment point offers the user linear force resistance to use to strengthen the body in a linear fashion.

Embodiments for attachments for wheel 16, for instance, a grip handle, are unique from existing similar inventions in the way that they align the center of rotation of, for example, the user's wrist with the center of rotation of the opposing force. Competing devices force the user to move the centerline of their wrist rotation off of the center line of rotation of the opposing force, thus forcing the user to experience a movement which is not naturally aligning with their body.

In a preferred embodiment, exercise apparatus 10 preferably comprises adjustable wheel platform arm 32. Preferably the position of wheel platform arm 32 can be adjusted vertically to various heights to accommodate different users. For example, a user can release lock 34, which preferably holds wheel platform arm 32 in place on center post 36, and raise or lower wheel platform arm 32 to a desired height position. Optionally, counterweight 38 will assist the user in lifting or lowering wheel platform arm 32 which is preferably connected to counterweight cable 40. Preferably counterweight cable 40 is guided through pulleys 42 in order to change the downward force of the gravitational force acting upon counterweight 38, into an upward force acting upon wheel platform arm 32. Preferably friction reduction materials (not shown), such as rollers, brushing, bearings, and the like, are placed between wheel platform arm 32 and center post 36 in housing 51.

Preferably, a user can adjust wheel platform arm 32 to multiple horizontal positions which allow use of various attachments for different exercise routines. For example, the user can insert easy insertion/release pin 46 through wheel platform arm pin hole 48, and through a degree selection hole 50. Preferably friction reduction materials (not shown), such as bearings, rollers, and the like, are placed between wheel platform arm 32, and center post 36. Easy rotation of wheel platform arm 32 is made possible with friction reduction material 44 placed between wheel platform arm 32 and friction material housing 52. Preferably cable 12 follows the center of rotation of wheel platform arm 32, as wheel platform arm 32 is rotated to user's selection of degree selection holes 50. Preferably the first pulley 54 guides cable 12 in a direct path to cable receiver 19, optionally said path is also the center of rotation of wheel platform arm 32. Preferably support handle 60 is disposed on or near center post 36 or other post of the apparatus, and is adjustable to move in/out and up/down, or be folded out of the way while remaining attached to the apparatus. Alternatively, support handle 60 is detachable.

Figure 4:
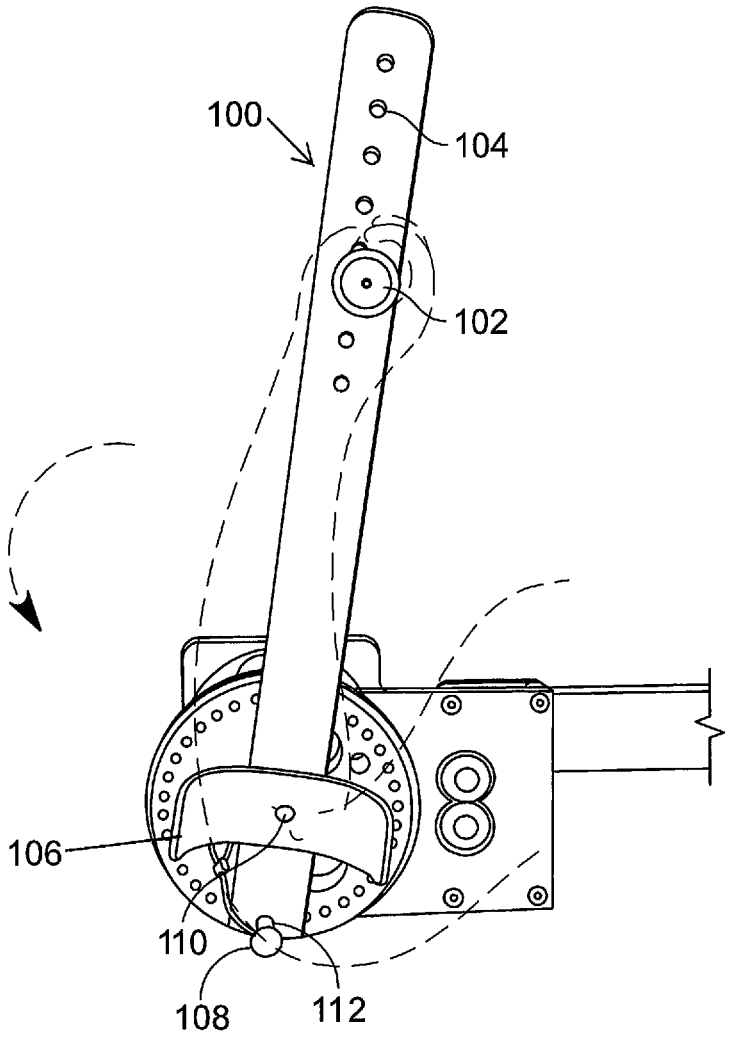
FIG. 4 is a perspective view of an embodiment of an elbow cradle attachment.

Referring to FIG. 4, in one embodiment, shoulder rotation exercises are accomplished by utilizing elbow cradle attachment 100, which is more effective than current exercise equipment when used to strengthen the shoulder joint and muscles in a supination, and/or pronation, and/or rotation motion. In this embodiment, the counteracting force preferably directly opposes the user's supination and pronation forces without any other forces interfering. The user preferably positions the arm in such a way that the supination and pronation of the shoulder is isolated, and exercised when moving through the selected range of motion. Preferably, elbow cradle attachment 100 comprises elbow cradle handle 102, handle mount selection holes 104, elbow positioning bumpers 106, easy insertion/release pin 108, and range of motion pin position hole 112. In one embodiment, easy insertion/release pin 108 is affixed to elbow cradle attachment 100. In a different embodiment, elbow cradle attachment 100 further comprises easy center pin positioning hole 110 through which another easy insertion/release pin (not shown) passes to be inserted into center perforation 28 (not shown). Preferably the user will change position of elbow cradle handle 102 by, for example, unscrewing it from threaded handle mount selection hole 104 and, for example, screwing it into the desired threaded handle mount selection hole 104. Preferably elbow positioning bumpers 106 keep the user's elbow in the position of directly over the center of rotation of wheel 16. Preferably the user can utilize elbow cradle attachment 100 with wheel 16 oriented in a vertical or horizontal plane relative to the wheel face.

Figure 5:
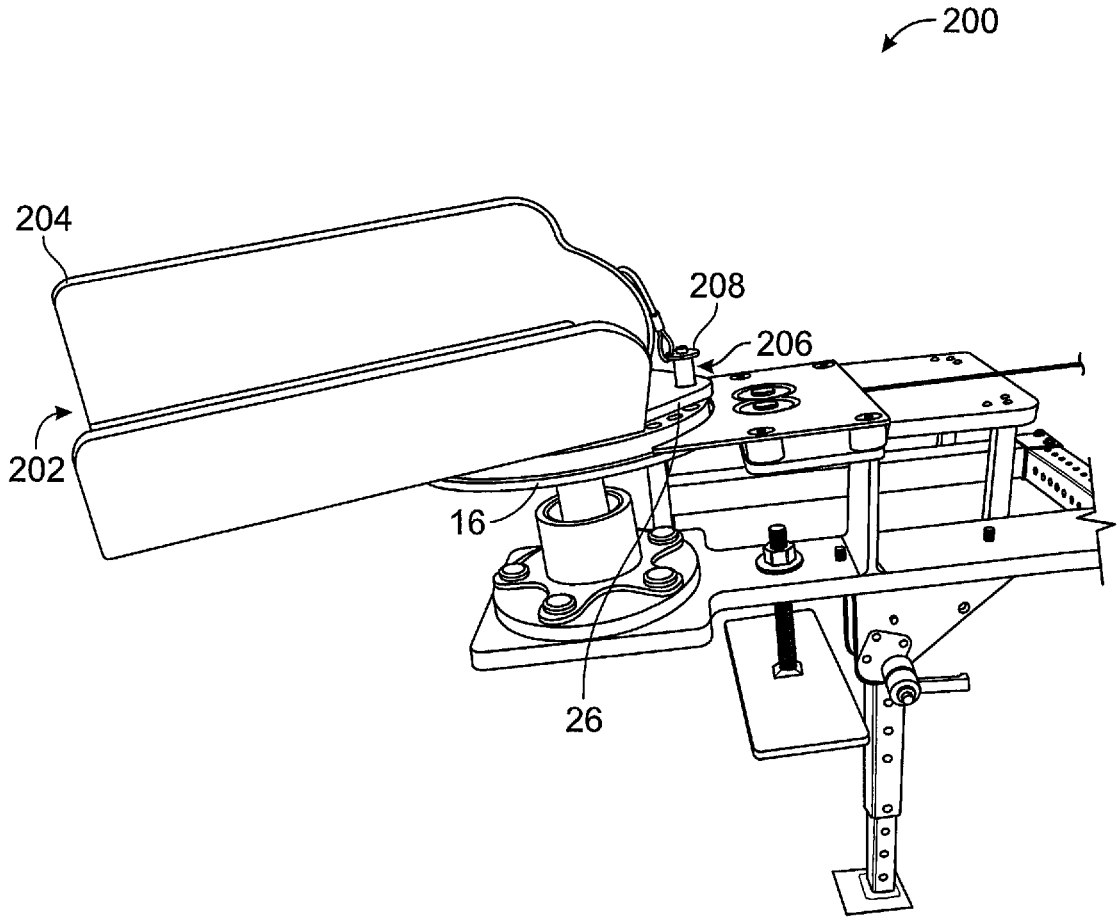
FIG. 5 is a perspective view of an embodiment of a knee cradle attachment.

Referring to FIG. 5, hip rotation exercises are carried out through knee cradle attachment 200 more effectively than that offered by current equipment when used to strengthen the hip joint and related muscles in a supination, and/or pronation motion, and/or rotation motion. The counteracting force from apparatus 10 directly opposes the user's supination, pronation, and/or rotation forces without any other forces interfering. The user positions their leg in such a way that the supination and pronation and rotation of the hip is isolated and exercised when moving through the selected range of motion. Preferably knee cradle attachment 200 comprises knee placement area 202, padding 204, pin position hole 206, and easy insertion/release pin 208. In one embodiment, an easy insertion/release pin (not shown) is affixed to knee cradle attachment 200. In a different embodiment, knee cradle attachment 200 further comprises easy center pin positioning hole (not shown) through which the easy insertion/release pin passes to be inserted into center perforation 28. The user preferably will select the position they wish to begin the motion by moving knee cradle attachment 200 to a position, then securing easy insertion/release pin 208 through range of motion pin positioning hole 206 into any one of off center perforations 26 in wheel 16.

Figure 6:
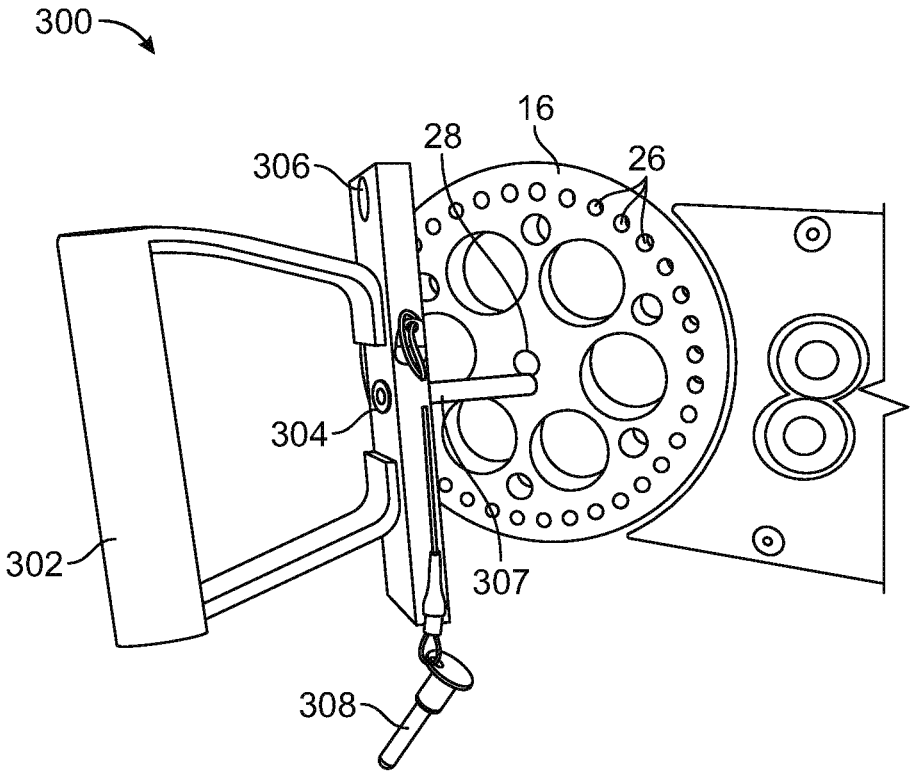
FIG. 6 is a perspective view of an embodiment of a grip handle attachment.

Referring to FIG. 6, arm and/or hand rotation and/or supination, and/or pronation is preferably provided through grip handle attachment 300, which is more effective than current exercise devices when used to strengthen the shoulder joint and related muscles in a supination, and/or pronation and/or rotation motion, and/or the wrist joint and related muscles in a supination, and/or pronation, and/or rotation motion, and/or the elbow joint and related muscles in a supination and/or pronation and/or rotation motion. The counteracting force from embodiments of the present invention directly opposes the user's supination and pronation forces without any other forces interfering. The user positions their arm in such a way that the supination and pronation of the shoulder and/or elbow and/or wrist is isolated and exercised when moving through the selected range of motion. Preferably, grip handle attachment 300 comprises grip surface 302, center pin position hole 304, range of motion pin position hole 306, easy insertion/release pins 307, and easy insertion/release pin 308. In one embodiment, easy insertion/release pin 307 is affixed to grip handle attachment 300. In a different embodiment, grip handle attachment 300 further comprises easy center pin positioning hole (not shown) through which easy insertion/release pin 307 passes to be inserted into center perforation 28, and easy insertion/release pin 308 passes through pin positioning hole 306 to be inserted into off center perforations 26 on wheel 16.

Figure 7:
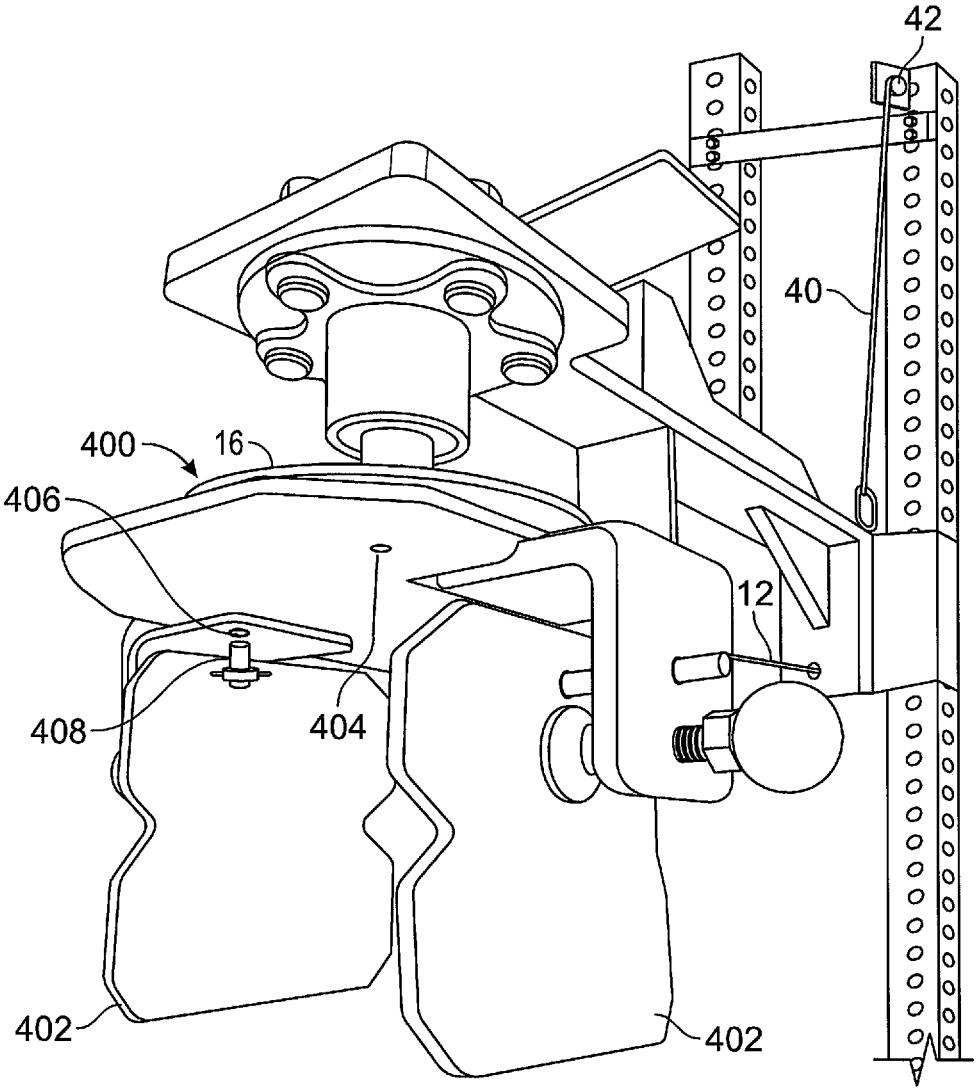
FIG. 7 is a perspective view of an embodiment of a head piece attachment.

Referring to FIG. 7, neck rotation is provided by utilizing head piece attachment 400, which is more effective than the prior art when used to strengthen the neck and/or related muscles in a left and/or right rotating motion. The counteracting force from the machine directly opposes the user's rotating forces without any other forces interfering. The user positions their head in such a way that the left and right rotation of the neck is isolated, and exercised when moving through the selected range of motion. Preferably, head piece attachment 400 comprises head clamps 402, center pin position hole 404, range of motion pin position hole 406, and easy insertion/release pin 408. The user will preferably insert an easy insertion/release pin (not shown) through center pin position hole 404 and into center perforation 28 on wheel 16, and easy insertion/release pin 408 through range of motion pin position hole 406 into off center perforations 26 in wheel 16. In one embodiment, the central easy insertion/release pin is affixed to head piece attachment 400.

Figure 8:
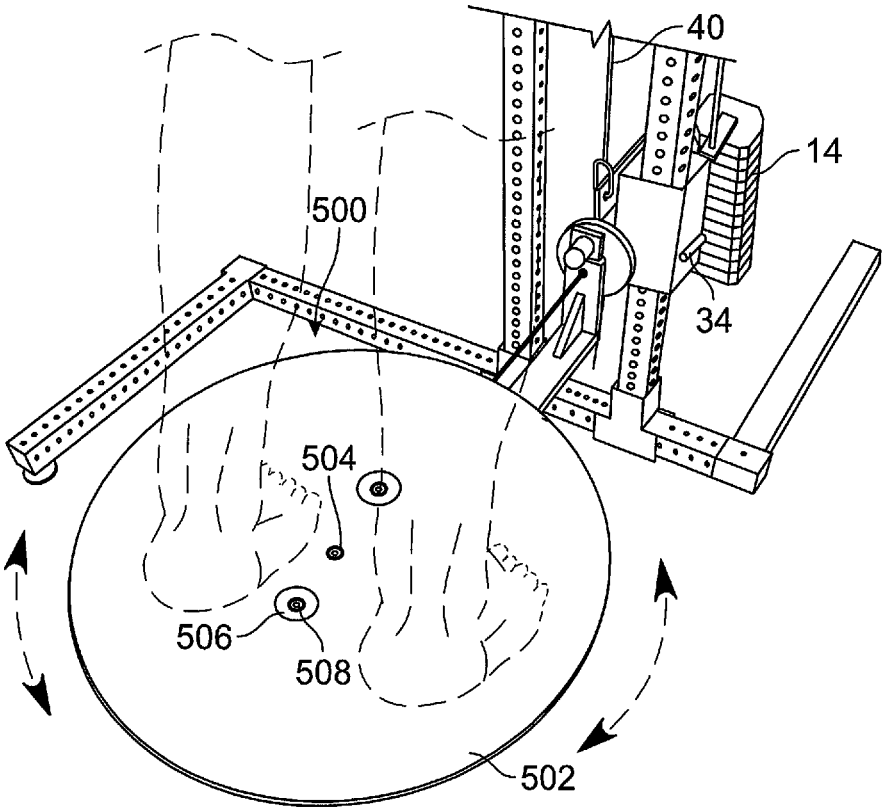
FIG. 8 is a perspective view of an embodiment of a foot plate attachment.

Referring to FIG. 8, hip and/or knee and/or ankle and/or spine rotation and/or pronation and/or supination provided by utilizing the foot plate attachment 500 in the present invention is more effective than the prior art when used to strengthen the hip joint and/or knee joint and/or ankle joint and/or spine and related muscles in a supination, and/or pronation, and/or rotation motion. The counteracting force from the machine directly opposes the user's supination and/or pronation and/or rotation forces without any other forces interfering. The user positions their leg or legs in such a way that the supination and/or pronation and/or rotation of the hip and/or knee and/or ankle and/or foot and/or spine is isolated, and exercised when moving through the selected range of motion. Preferably, foot plate attachment 500 comprises foot placement surface 502, center pin position hole 504, other pin position hole 506, and easy insertion/release pin 508. The user will preferably insert an easy insertion/release pin (not shown) through center pin position hole 504 into center perforation 28 on wheel 16, which is under foot plate attachment 500, and easy insertion/release pin 508 through pin position hole 506 into off center perforations 26 on wheel 16. In one embodiment, the central easy insertion/release pin is affixed to foot plate attachment 500.

Figure 9:
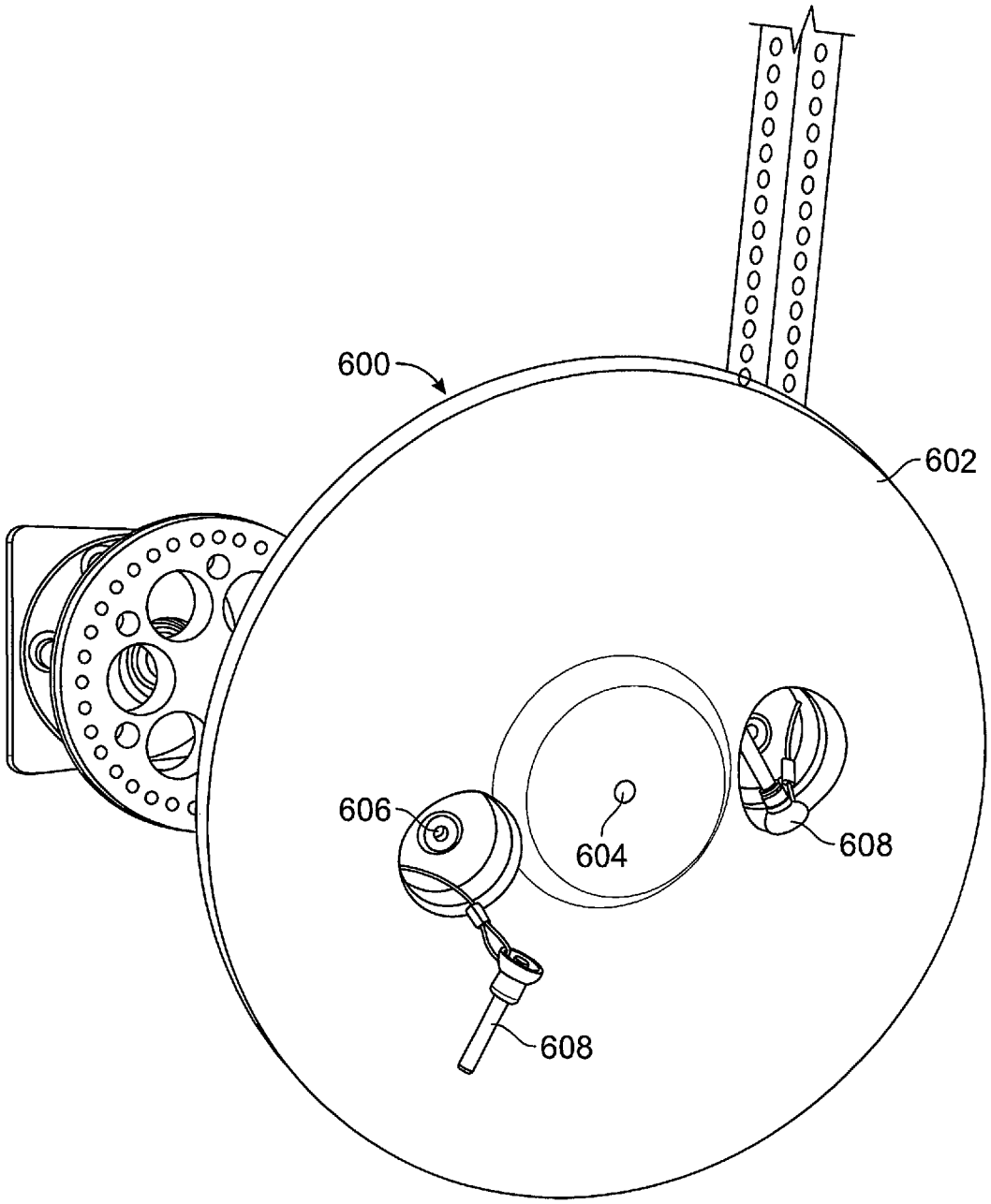
FIG. 9 is a perspective view of an embodiment of a hand plate attachment.

Referring to FIG. 9, shoulder rotation and/or wrist rotation and/or elbow rotation and/or hand provided by utilizing the hand plate attachment 600 in the current invention is more effective than the prior art when used to strengthen the shoulder joint and/or elbow joint and/or wrist joint and related muscles in a supination, and/or pronation and/or rotation motion. The counteracting force from the machine directly opposes the user's supination and pronation forces without any other forces interfering. The user positions their arm in such a way that the supination and pronation of the shoulder and/or elbow and/or wrist and/or hand are isolated, and exercised when moving through the selected range of motion. Preferably, hand plate attachment 600 comprises hand placement surface 602, center pin position hole 604, other pin position hole 606, and easy insertion/release pins 608. The user will preferably insert an easy insertion/release pin (not shown) through center pin position hole 604 into center perforation 28 on wheel 16, and easy insertion/release pins 608 into off center perforations 26 on wheel 16. In one embodiment, the central easy insertion/release pin is affixed to hand plate attachment 600.

Figure 10:
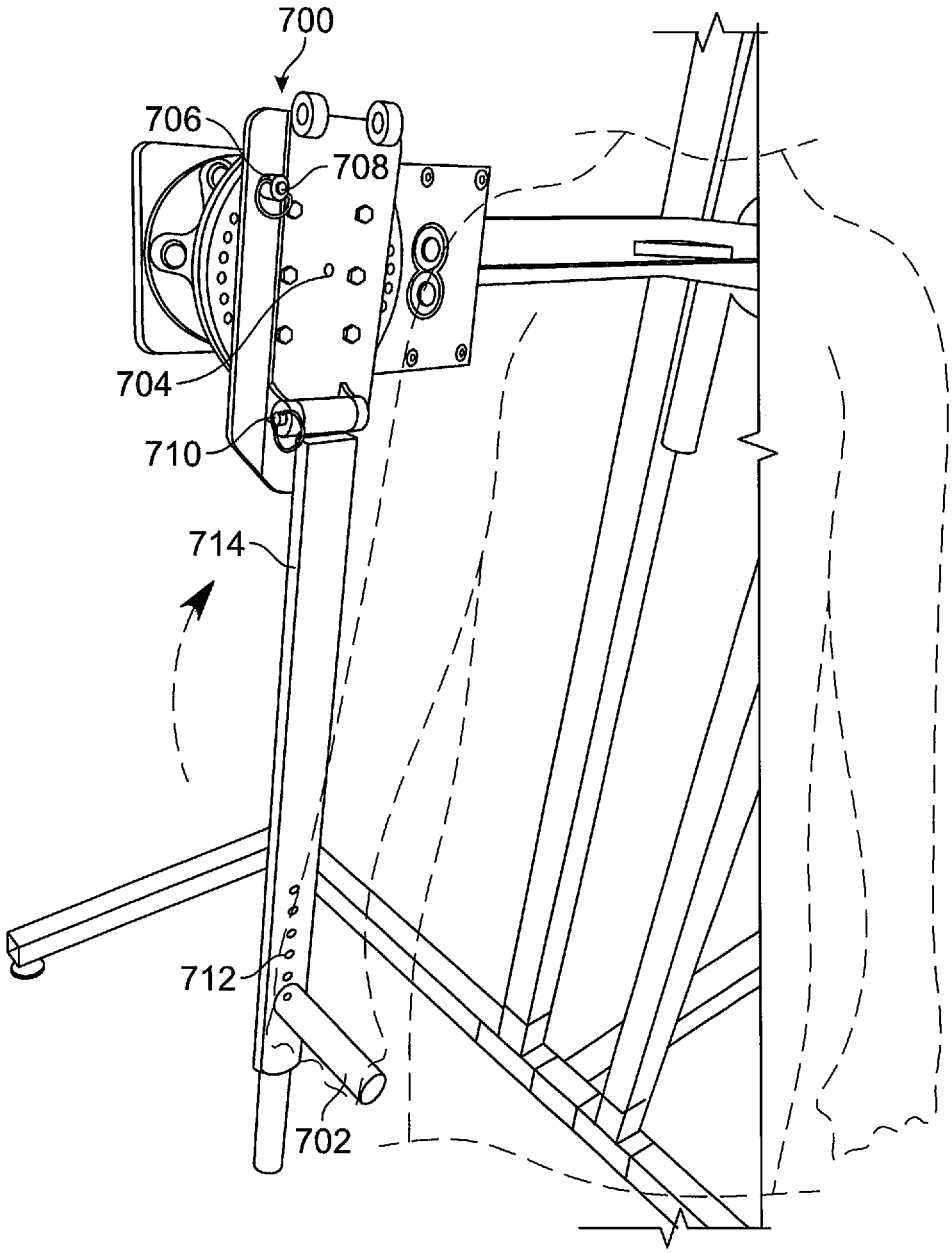
FIG. 10 is a perspective view of an embodiment of a long shoulder handle.

Referring to FIG. 10, shoulder rotation provided by utilizing long shoulder handle attachment 700 in the present invention is more effective than the prior art when used to strengthen the shoulder joint and related muscles in a supination, and/or pronation and/or rotation motion. The counteracting force from the machine directly opposes the user's supination and/or pronation and/or rotation forces without any other forces interfering. The user positions their arm in such a way that the supination and/or pronation and/or rotation of the shoulder is isolated, and exercised when moving through the selected range of motion. Preferably, long shoulder handle attachment 700 comprises removable handle 702, center pin position hole 704, range of motion pin position hole 706, and easy insertion/release pin 708. The user will preferably insert an easy insertion/release pin (not shown) through center pin positioning hole 704 into center perforation 28 on wheel 16, and easy insertion/release pin 708 through range of motion pin position hole 706 into off center perforations 26 on wheel 16. Preferably user will remove removable handle 702 and place it into removable handle insertion points 712 of their choice. Optionally, user can remove long arm 714 by releasing easy release hinge 710. In one embodiment, the central easy insertion/release pin is affixed to long shoulder handle attachment 700.

Figure 11:
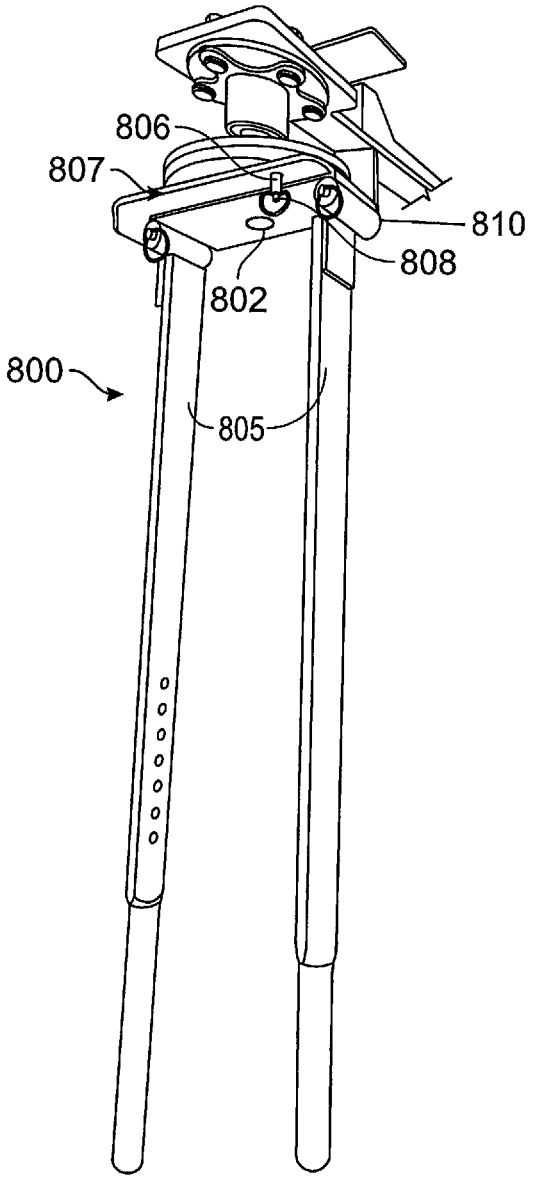
FIG. 11 is a perspective view of an embodiment of a long over-head handles attachment.

Referring to FIG. 11, spine rotation and/or hip rotation and/or knee rotation and/or ankle rotation provided by utilizing long overhead handles attachment 800 is more effective than the prior art when used to strengthen the spine and/or hip and/or knee and/or ankle joints and related muscles in a rotating motion. The counteracting force from the machine directly opposes the user's rotation forces without any other forces interfering. The user positions their body in such a way that the rotation and/or supination and/or pronation of the spine and/or hip and/or knee and/or ankle and/or foot and related muscles are isolated, and exercised when moving through the selected range of motion. Preferably, long overhead handles attachment 800 comprises center pin position hole 802, range of motion pin position hole 806, long arms 805, and one or more easy release hinges 810. The user will preferably an insert easy insertion/release pin (not shown) through center pin positioning hole 802 into center perforation 28 on wheel 16, and pin 808 through range of motion pin position hole 806 into off center perforations 26 on wheel 16. Optionally user can remove long arms 808 by removing easy release hinge(s) 810. In one embodiment, the central easy insertion/release pin is affixed to long overhead handles attachment 800.

Figure 12:
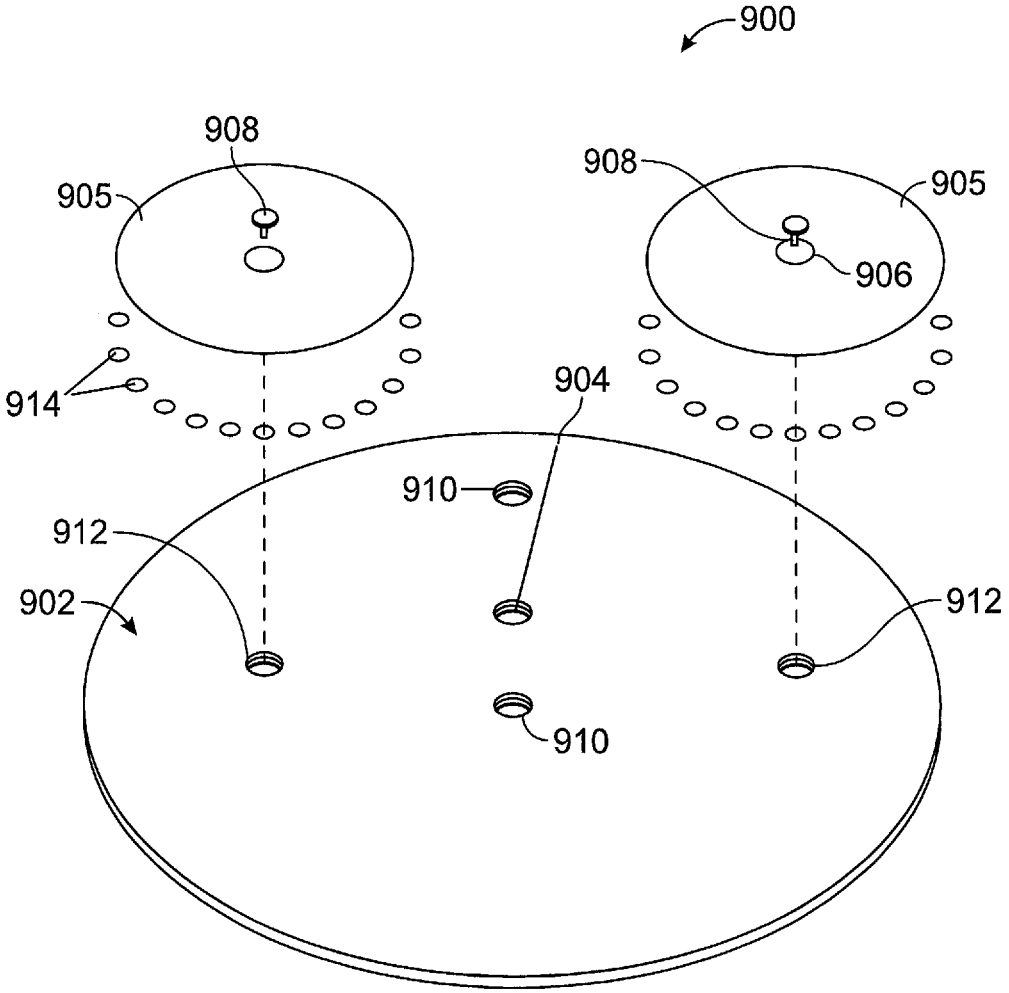
FIG. 12 is a perspective view of an embodiment of a twin free foot spin foot plate attachment.

Referring FIG. 12, hip and/or knee and/or ankle and/or spine rotation and/or supination and/or pronation provided by utilizing twin free spin foot plate attachment 900 is more effective than the prior art when used to strengthen the spine and/or hip and/or knee and/or ankle joints and related muscles in a supination, and/or pronation and/or rotation motion. The counteracting force from the machine directly opposes the user's supination and/or pronation and/or rotation forces without any other forces interfering. Preferably, twin free spin foot plate attachment 900 comprises support surface 902, center pin position hole 904, range of motion pin position holes 910, easy insertion/release pin 908, foot pads 905, pin holes 912, and bearings 914. The user will preferably insert an easy insertion/release pin (not shown) through center pin positioning hole 904 into center perforation 28 on wheel 16, which is underneath support surface 902, and easy insertion/release pins (not shown) through range of motion pin position holes 910 into off center perforations 26 on wheel 16. In one embodiment, the easy insertion/release pins are affixed to twin free spin foot plate attachment 900.

Figure 13:
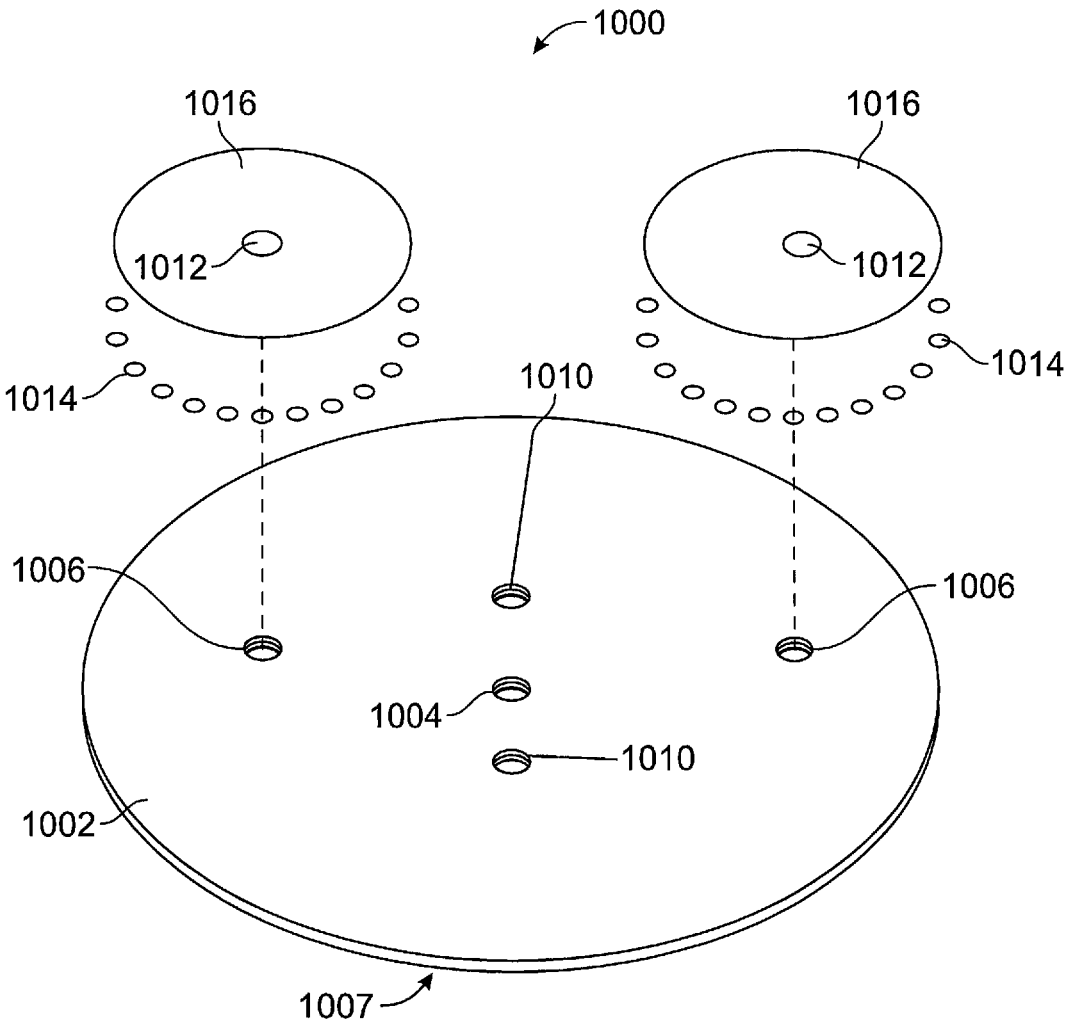
FIG. 13 is a perspective view of an embodiment of a twin free hand spin foot plate attachment.

Referring to FIG. 13, in one embodiment, shoulder and/or elbow and/or wrist supination and/or pronation and/or rotation provided by utilizing the twin free spin hand plate 1000 attachment in the present invention is more effective than the prior art when used to strengthen the shoulder and/or elbow and/or hands and/or wrist joints and related muscles in a supination, and/or pronation and/or rotation motion. The counteracting force from the machine directly opposes the user's supination and/or pronation and/or rotation forces without any other forces interfering. The user positions their arms in such a way that the supination and/or pronation and/or rotation of the shoulder and/or elbow, and/or wrist and/or hands are isolated, and exercised when moving through the selected range of motion. Preferably, twin free spin hand plate attachment 1000 comprises support surface 1002, center pin position hole 1004, range of motion pin position holes 1010, hand pads 1016, pin hole 1012, which aligns with support surface pin holes 1006, and bearings 1014. The user will preferably insert an easy insertion/release pin (not shown) through center pin positioning hole 1004 and into center perforation 28 on wheel 16, which is under support surface 1002, and insert easy insertion/release pins (not shown) through range of motion pin position holes 1010 into off center perforations in wheel 26 on wheel 16. In one embodiment, the easy insertion/release pins are affixed to twin free spin hand plate 1000.

Figure 14:
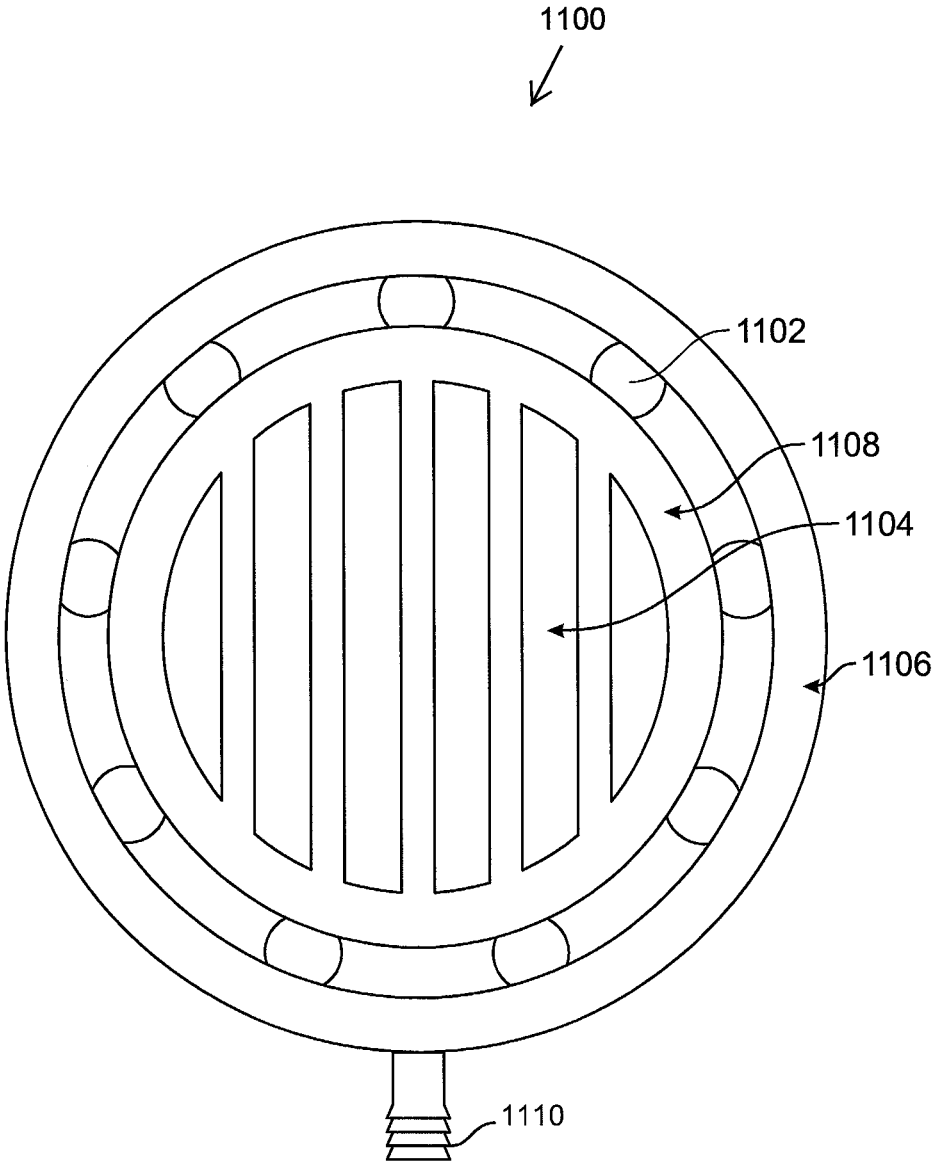
FIG. 14 is a perspective view of an embodiment of a free spinning finger cradle attachment.

Referring to FIG. 14, shoulder rotation and/or elbow rotation and/or wrist rotation and/or spine rotation provided by utilizing free spinning finger cradle attachment 1100 in the current invention is more effective than the prior art when used to strengthen the shoulder joint and/or elbow joint and/or wrist joint and/or the spine and related muscles in a supination, and/or pronation and/or rotational motion. The counteracting force from the machine directly opposes the user's supination, pronation, and rotational forces without any other forces interfering. The free spinning finger cradle attachment allows the user to supinate or pronate their hand freely, without an opposing force applied to that particular supination or pronation, while pronating and/or supinating and/or rotating another body part. Preferably free spinning finger cradle attachment 1100 comprises bearings 1102, finger placement slots 1104, outer housing 1106, inner housing 1108, and threaded insertion 1110. Preferably free spinning finger cradle attachment 1100 is attached to elbow cradle attachment 100 in place of the elbow cradle handle 102 (shown in FIG. 4), or to long shoulder handle attachment 700, in place of removable handle 702 (shown in FIG. 10).

INDUSTRIAL APPLICABILITY

The invention is further illustrated by the following non-limiting examples.

Example 1

An exercising apparatus was build out of metal and plastic, significantly similar to the one shown in FIG. 1. When tested to strengthen the body's joints and muscles in a supination, and/or pronation and/or rotational motion, the counteracting force from the machine directly opposed the user's supination, pronation, and rotational forces without any other forces interfering. The various attachments allowed the user to supinate or pronate particular body parts freely, without an opposing force applied to that particular supination or pronation, while pronating and/or supinating and/or rotating other body parts.

The preceding example can be repeated with similar success by substituting the generically or specifically described components and/or operating parameters of this invention for those used in the preceding examples. Note that in the specification and claims, "about" or "approximately" means within twenty percent (20%) of the numerical amount cited. Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A variable resistance exercise apparatus comprising:

a component comprising a platform attached to a bidirectionally rotatable element of the variable resistance exercise apparatus, said platform configured to receive at least one foot of a user of the variable resistance exercise apparatus; and a force transferring material providing bidirectional variable rotational resistance to said bidirectionally rotatable element and said component;

wherein said force transferring material attaches to said bidirectionally rotatable element at a single point.

2. The variable resistance exercise apparatus of claim 1 wherein said bidirectionally rotatable element comprises a circular wheel.

3. The variable resistance exercise apparatus of claim 1 wherein said force transferring material is disposed on a periphery of said bidirectionally rotatable element.

4. The variable resistance exercise apparatus of claim 3 wherein said force transferring material is disposed in a groove on the periphery of said bidirectionally rotatable element.

5. The variable resistance exercise apparatus of claim 1 wherein said force transferring material is selected from the group consisting of a cable, a belt, a chain, a rope, and a rubber band.

6. The variable resistance exercise apparatus of claim 1 wherein said force transferring material is guided with one or more pulleys disposed in proximity to said bidirectionally rotatable element.

7. The variable resistance exercise apparatus of claim 1 wherein said bidirectionally rotatable element is disposed on a horizontal arm.

8. The variable resistance exercise apparatus of claim 7 wherein said horizontal arm is fixed and not vertically adjustable.

9. The variable resistance exercise apparatus of claim 7 wherein said horizontal arm is vertically adjustable above a support surface for the variable resistance exercise apparatus.

10. The variable resistance exercise apparatus of claim 9 wherein said horizontal arm is vertically adjustable up to approximately 10 feet high above the support surface.

11. The variable resistance exercise apparatus of claim 1 wherein the bidirectional variable rotational resistance is provided by a source selected from the group consisting of magnetic devices, electric devices, springs, adjustable weights, stretching a flexible material, hydraulics, and pneumatic devices.

12. The variable resistance exercise apparatus of claim 1 wherein the component is removable from the bidirectionally rotatable element by the user.

13. The variable resistance exercise apparatus of claim 1 wherein said force transferring material wraps either clockwise or counterclockwise around said bidirectionally rotatable element, thereby providing the bidirectional variable rotational resistance.

14. The variable resistance exercise apparatus of claim 1 wherein said bidirectionally rotatable element comprises a plate fixed in a horizontal plane.

15. The variable resistance exercise apparatus of claim 1 wherein said bidirectionally rotatable element comprises a plate that is tiltable between 0 and 360 degrees about a horizontal axis.

16. The variable resistance exercise apparatus of claim 1 wherein a counteracting force provided by said bidirectionally rotatable element is configured to directly oppose a user's supination and/or pronation and/or rotation forces without any other forces interfering.

* * * * *